US006864868B2

(12) United States Patent
Kawano

(10) Patent No.: US 6,864,868 B2
(45) Date of Patent: Mar. 8, 2005

(54) CONTROL DEVICE OF A LIQUID CRYSTAL DISPLAY DEVICE

(75) Inventor: Hideo Kawano, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 231 days.

(21) Appl. No.: 10/173,862

(22) Filed: Jun. 19, 2002

(65) Prior Publication Data

US 2003/0016203 A1 Jan. 23, 2003

(30) Foreign Application Priority Data

Jun. 20, 2001 (JP) ..... 2001-187281

(51) Int. Cl.[7] ..... G09G 3/36
(52) U.S. Cl. ..... 345/87; 345/89
(58) Field of Search ..... 345/87, 88, 89, 345/90, 92, 94, 96, 99, 147; 340/815.53

(56) References Cited

U.S. PATENT DOCUMENTS 6,020,870 A * 2/2000 Takahashi et al. ..... 345/92
6,166,714 A * 12/2000 Kishimoto ..... 345/96
6,313,818 B1 * 11/2001 Kondo et al. ..... 345/89
6,337,726 B1 1/2002 Kawano et al. ..... 349/141
2002/0024481 A1 * 2/2002 Kawabe et al. ..... 345/87
2002/0063828 A1 * 5/2002 Negoro et al. ..... 349/117

* cited by examiner

*Primary Examiner*—Vijay Shankar
*Assistant Examiner*—Nitin Patel
(74) *Attorney, Agent, or Firm*—Oblon, Spivak, McClelland, Maier & Neustadt, P.C.

(57) ABSTRACT

A control device of an IPS-mode or other mode liquid crystal display device for increasing response speed without diminishing elastic torque of the liquid crystal. Image signals are supplied in such a manner that one display pattern is displayed in first and second, two consecutive frames. When to increase voltage of the image signal for changing luminance, voltage at the first frame being set higher than a voltage value of gradation scale corresponding to a given luminance; and voltage at the second frame being set to a voltage value of gradation scale corresponding to the given luminance. Meanwhile, when to decrease voltage of the image signal for changing luminance, voltage at the first frame being set lower than a voltage value of gradation scale corresponding to a given luminance; and voltage at the second frame being set to a voltage value of gradation scale corresponding to the given luminance.

7 Claims, 4 Drawing Sheets

CONTROL DEVICE OF A LIQUID CRYSTAL DISPLAY DEVICE

BACKGROUND OF THE INVENTION

The present invention relates to a control device of a liquid crystal display device of the IPS mode or the like.

Recently, liquid crystal display devices having large substrate sizes and ones having high resolutions have come to spread. In addition, liquid crystal display devices having large viewing angles are now desired.

Among liquid crystal display devices having large viewing angles are IPS (in-plane switching)-mode liquid crystal display devices in which display is performed by driving a liquid crystal (IPS-mode liquid crystal) by lateral electric fields produced by pairs of liquid crystal driving electrodes that are provided on one substrate.

Although having large viewing angles, IPS-mode liquid crystal display devices have a problem that the response speed is low, that is, the relaxation time of liquid crystal molecule displacements corresponding to a variation of a voltage applied to a liquid crystal layer is long. More specifically, when the screen refresh rate is 60 Hz, the response time is longer than 30 ms, that is, two times or more longer than the frame period of 16.7 ms.

One method for increasing the response speed has been proposed in which the viscosity of a liquid crystal is reduced to make liquid crystal molecules to be displaced more easily by torque that is given by an electric field. More specifically, in IPS-mode liquid crystal display devices, liquid crystal molecules receive electric field torque and liquid crystal's elastic torque. Reducing the viscosity lowers the elastic torque. As a result, for the same electric field torque, the angular acceleration of liquid crystal molecules is increased by the reduction in elastic torque.

However, when the angular displacement of liquid crystal molecules is becoming small, the reduction in elastic torque makes the relaxation time longer. Since the response speed is determined by the above two factors, the method of merely reducing the viscosity of a liquid crystal cannot make the response speed sufficiently high.

In view of the above problems, it is aimed to provide a control device of a liquid crystal display device which can increase the response speed of liquid crystal display devices of the IPS mode and other modes without lowering the liquid crystal elastic torque.

BRIEF SUMMARY OF THE INVENTION

According to first aspect of the invention, a control device of a liquid crystal display device, comprising: an array substrate comprised of signal lines, scanning lines being arranged perpendicular to the signal lines, switching elements each being arranged in vicinity of respective crossing point of the signal line and the scanning line, and pixel electrodes each being connected to respective one of the switching elements; a counter substrate being opposed to the array substrate with a liquid crystal layer interposed therebetween; a signal line driving circuit for supplying image signals to the respective signal lines; and a scanning line driving circuit for supplying gate signals to the respective scanning lines, the gate signals serving to turn on the switching elements to write the image signals to the pixel electrodes; said image signals being supplied in a manner for displaying one display pattern during two consecutive frame periods consisting of first and second frames; and when to increase voltage of the image signal as to change luminance (e.g., the display gradation level is changed from black to white in the normally black mode), voltage at the first frame being set higher than a voltage value of gradation scale corresponding to a given luminance; and voltage at the second frame being set to a voltage value of gradation scale corresponding to the given luminance.

According to second aspect of the invention, control device of a liquid crystal display device, comprising: an array substrate comprised of signal lines, scanning lines being arranged perpendicular to the signal lines, switching elements each being arranged in vicinity of respective crossing point of the signal line and the scanning line, and pixel electrodes each being connected to respective one of the switching elements; a counter substrate being opposed to the array substrate with a liquid crystal layer interposed therebetween; a signal line driving circuit for supplying image signals to the respective signal lines; and a scanning line driving circuit for supplying gate signals to the respective scanning lines, the gate signals serving to turn on the switching elements to write the image signals to the pixel electrodes; said image signals being supplied in a manner for displaying one display pattern during two consecutive frame periods consisting of first and second frames; and when to decrease voltage of the image signal as to change luminance (e.g., the display gradation level is changed from white to black in the normally black mode), voltage at the first frame being set lower than a voltage value of gradation scale corresponding to a given luminance; and voltage at the second frame being set to a voltage value of gradation scale corresponding to the given luminance.

In each of the above control devices, the liquid crystal layer may be formed of an IPS-mode, TN-mode, STN-mode, or VA-mode liquid crystal.

DETAILED DESCRIPTION OF THE INVENTION

An active matrix liquid crystal display device 10 according to an embodiment of the present invention will be hereinafter described with reference to FIGS. 1–4.

<Construction of Liquid Crystal Display Device>

The construction of the liquid crystal display device 10 will be described below with reference to FIG. 1.

The liquid crystal display device 10 comprises a liquid crystal panel 12 of normally black mode having color pixels in UXGA arrangement and having a viewing area of, for example, 15 inches in diagonal size.

Figure 1:
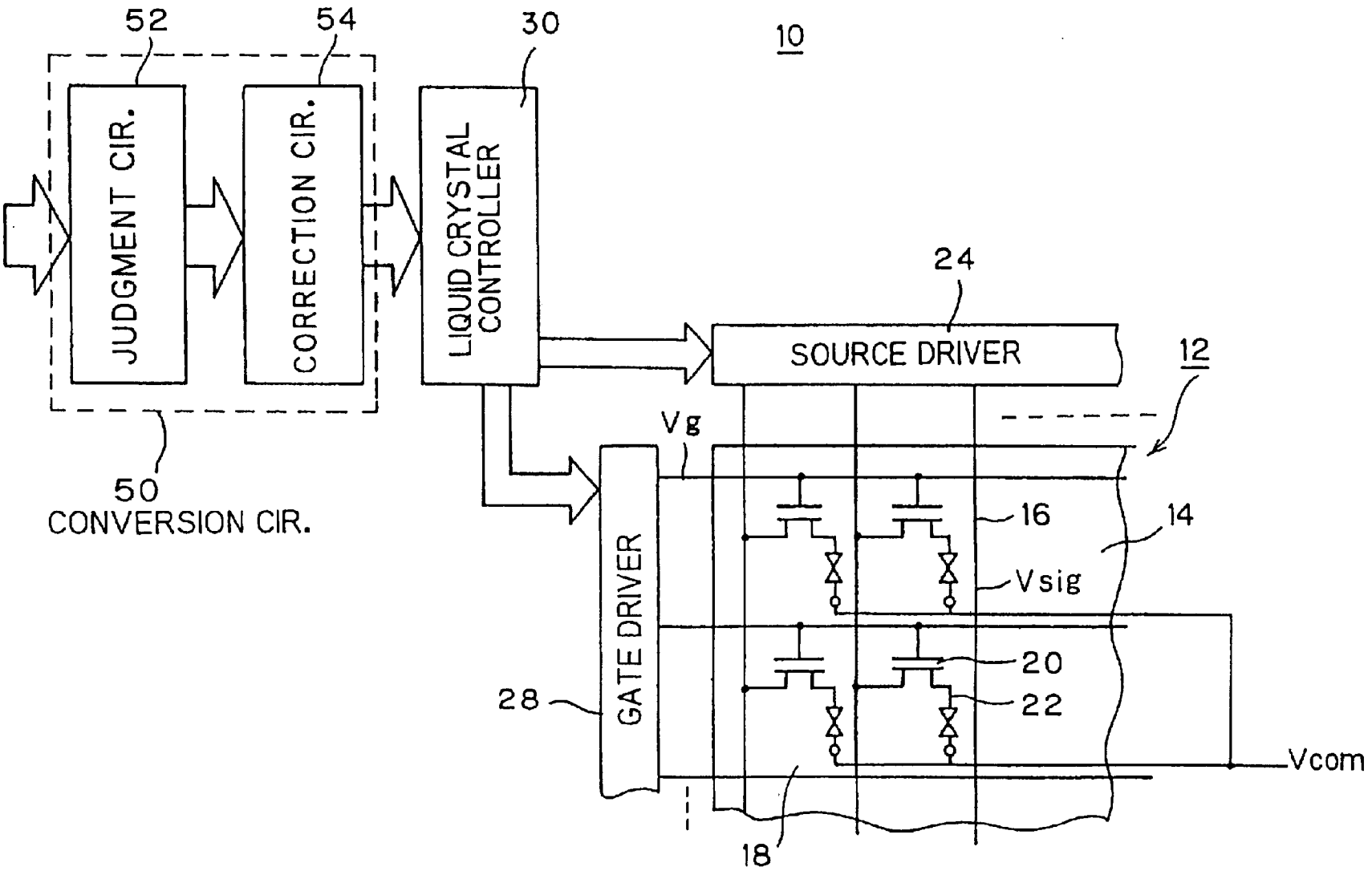
FIG. 1 is a block diagram of a liquid crystal display device according to an embodiment of the present invention.

As shown in FIG. 1, the liquid crystal panel 12 comprises an array substrate 14 that is comprised of: 1,600×3 (R, G, and B) signal lines 16; 1,200 scanning lines 18 that are perpendicular to the signal lines 16; TFTs 20 each of which is arranged in a vicinity of respective one of crossing points of the signal lines 16 and the scanning lines 18; and pixel electrodes 22 that are connected to the respective TFTs 20. The liquid crystal panel 12 also comprises: a counter electrode substrate (not shown) that has color filters and is opposed to the array substrate 14 with a prescribed gap; and a liquid crystal layer (not shown) that is interposed between the array substrate 14 and the counter electrode substrate. The liquid crystal layer is formed of an IPS-mode liquid crystal.

Each scanning line 18 is electrically connected to the gates of TFTs 20; each signal line 16 is electrically connected to the drains of TFTs 20; and each pixel electrode 22 is electrically connected to the source of the associated TFT 20. With this structure, image signals Vsig that are supplied to the signal lines 16 are written to pixel electrodes 22 according to a gate signal Vg that is supplied to a scanning line 18. Display is performed according to potential differences between the pixel electrodes 22 and a counter electrode.

The signal lines 16 are connected to a source driver 24. The source driver 24 produces analog image signals Vsig by digital-to-analog wise (D/A) converting a digital image data signal DATA, and supplies the analog image signals Vsig to the signal lines 16. The scanning lines 18 are connected to a gate driver 28 and supplied with gate signals Vg by the gate driver 28.

The liquid crystal display panel 12 is also provided with a liquid crystal controller 30 that controls the source driver 24 and the gate driver 28. The liquid crystal controller 30 supplies the source driver 24 with a horizontal clock signal XCLK, a horizontal start signal STH, the above-mentioned image data signal DATA, and a polarity inversion signal POL. The liquid crystal controller 30 supplies the gate driver 28 with a vertical clock signal YCLK, a vertical start signal STV, and an output disable signal OE.

A conversion circuit 50 for converting image data is provided upstream of the liquid crystal controller 30. The conversion circuit 50 is composed of a judgment circuit 52 and a correction circuit 54. The conversion circuit 50 receives image data from a DVD device, a digital TV receiver, or the like, converts it into image data, in a manner to increase the response speed of the liquid crystal display device 10 as will be described later, and outputs the image data thus obtained.

<Mechanism for Increasing Response Speed>

A method for increasing the response speed of the liquid crystal display device 10 having the above configuration will be described below.

As described in the "BACKGROUND OF THE INVENTION" section, IPS-mode liquid crystal molecules receive electric field torque and liquid crystal elastic torque. To increase the luminance (e.g., black to a halftone level or white) in the normally black mode, it is necessary to apply an electric field to the liquid crystal. Conversely, the liquid crystal's elastic torque serves to decrease the luminance (e.g., white or a halftone level to black). In view of the above, in this embodiment, to increase the luminance, the electric field torque is made stronger than usual so as to give larger angular acceleration to liquid crystal molecules. To decrease the luminance, the application voltage is minimized to allow the elastic torque to act effectively.

First, the response time at luminance-increasing wise change (hereinafter referred to as "on-response time") will be described with reference to FIG. 2.

Figure 2:
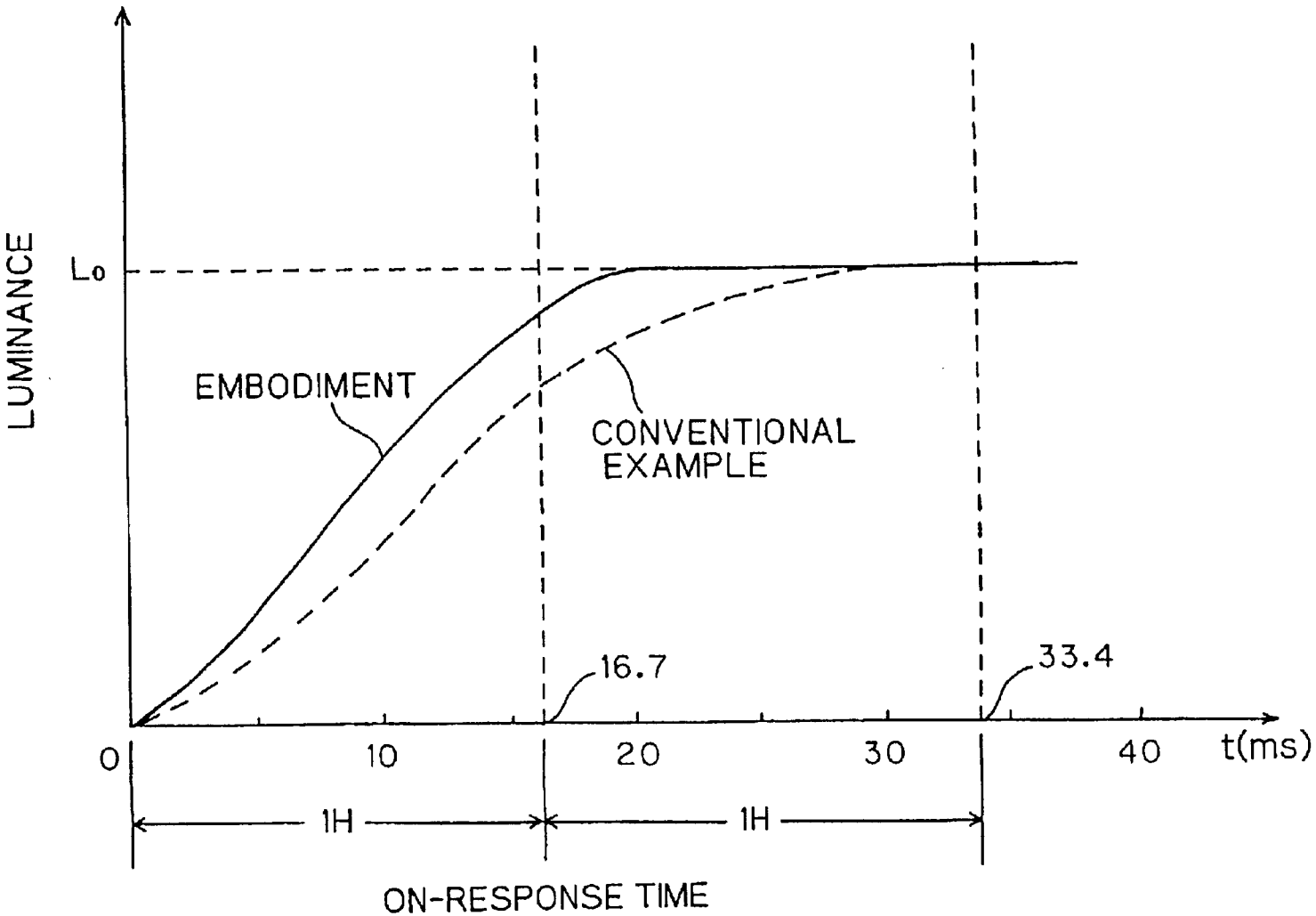
FIG. 2 is a graph showing luminance vs. on-response time curves.

FIG. 2 is a graph showing luminance (vertical axis) vs. on-response time (horizontal axis) curves of a conventional example and the embodiment, in which the screen refresh rate is 60 Hz and the luminance is changed from black to white. Where the refresh rate is 60 Hz, one frame period is equal to 16.7 ms and one display pattern is displayed in two frame periods (33.4 ms).

In the conventional example, the image signal voltages that are applied to the liquid crystal in the first frame and the second frame, respectively, are the same voltage value of white-displaying level. The on-response time that is taken to reach a white reference luminance value L0 is about 33 ms, which is almost equal to two frame periods.

In the embodiment, in the first frame, the image signal voltage is somewhat higher than the voltage value of white-displaying level so that electric field torque that is stronger than usual is applied to liquid crystal molecules. The on-response time that is taken to reach the white reference luminance value LO is about 20 ms.

That is, the response time is shortened from about 33 ms (conventional example) to about 20 ms (embodiment).

Next, the response time at luminance-decreasing wise change (hereinafter referred to as "off-response time") will be described with reference to FIG. 3.

Figure 3:
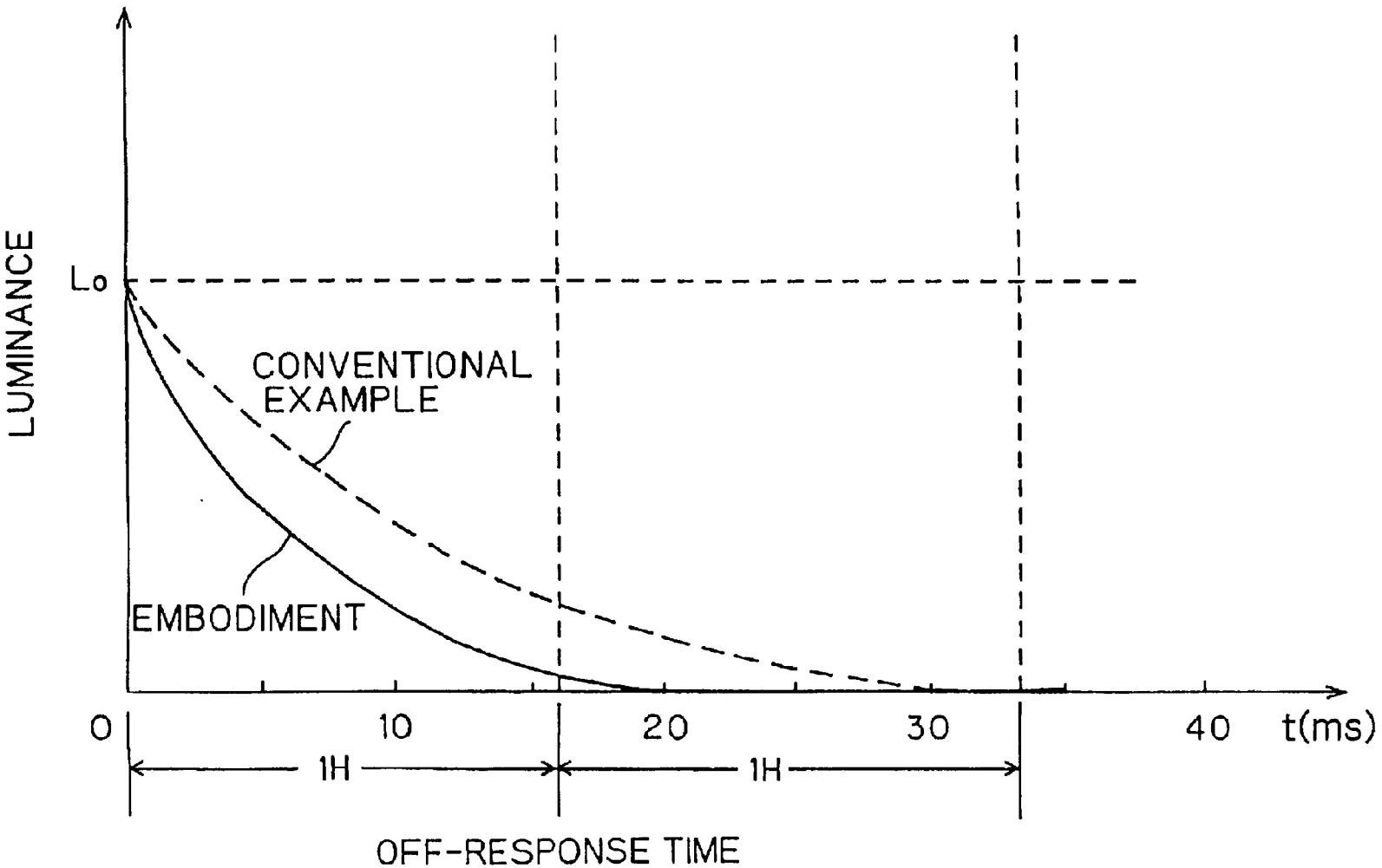
FIG. 3 is a graph showing luminance vs. off-response time curves.

FIG. 3 is a graph showing luminance (vertical axis) vs. off-response time (horizontal axis) curves of a conventional example and the embodiment, in which the screen refresh rate is 60 Hz and the luminance is changed from white to black.

In the conventional example, the image signal voltages that are applied to the liquid crystal in the first frame and the second frame, respectively, are the same voltage value of black-displaying level. The off-response time is about 30 ms.

In the embodiment, in the first frame, the image signal voltage is set equal to a counter voltage or common-electrode voltage Vcom of the counter electrode substrate. In the second frame, the image signal voltage is made equal to the voltage value of black-displaying level. In this case, in the first frame, the application voltage is almost equal to zero and hence liquid crystal molecules are displaced only by elastic torque; and the displacement speed of liquid crystal molecules is increased accordingly. The off-response time is about 20 ms.

That is, also in the case of decreasing the luminance, the response time is shortened from about 30 ms (conventional example) to about 20 ms (embodiment).

<Operation of Liquid Crystal Display Device 10>

The conversion circuit 50 is an implementation of the above mechanism.

In the conversion circuit 50, the judgment circuit 52 judges, on a pixel-by-pixel basis, whether image data that is received from a DVD device, a TV receiver, or the like is image signals are in a manner of luminance-increasing wise or luminance-decreasing wise change or of non-changing of the luminance; then the judgment circuit 52 outputs a signal at either of three kinds of judgment values, to the correction circuit 54.

When the image data are of luminance-increasing wise change, in the first frame, the correction circuit 54 makes a correction by making a voltage of gradation scale as higher than usual. Conversely, when the image data are of luminance-decreasing wise change, in the first frame, the correction circuit 54 makes a correction by setting the voltage of gradation scale as equal to the counter voltage Vcom of the counter electrode substrate. When the image data are of non-changing of the luminance, the correction circuit 54 does not correct the voltage of gradation scale and outputs such voltage as received.

As described above, the image data is classified into three kinds and then output to the liquid crystal controller 30 after being corrected or kept as it is.

The liquid crystal controller 30 performs the same signal processing as that for ordinary image data, and outputs resulting image data to the source driver 24.

<Image Signals Vsig>

Image signals Vsig that are outputted from the source driver 24 will be described below in such a manner as to be compared with ones in a conventional example.

Figure 4:
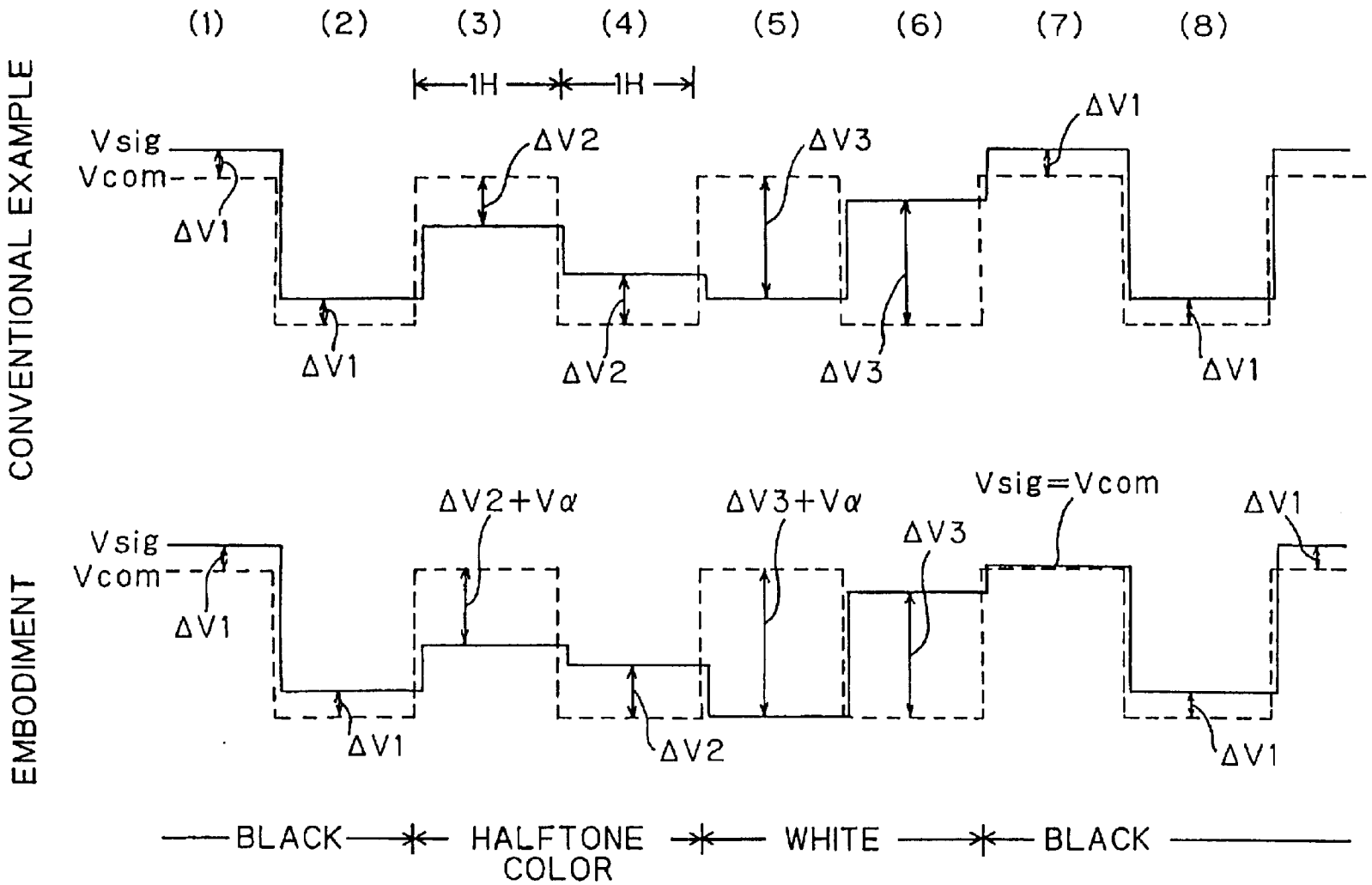
FIG. 4 shows waveforms of an image signal Vsig and a counter voltage Vcom.

The top part of FIG. 4 shows waveforms of an image signal Vsig and a counter voltage Vcom of a conventional example. The bottom part of FIG. 4 shows waveforms of an image signal Vsig and a counter voltage Vcom of the embodiment.

In each of the conventional example and the embodiment, black is displayed in frames (1) and (2); a halftone color is displayed in frames (3) and (4); white is displayed in frames (5) and (6); and black is displayed in frames (7) and (8). The polarity of the counter voltage Vcom is inverted every frame. FIG. 4 also shows differences between the image signal Vsig and the counter voltage Vcom. The image signal Vsig is written to a pixel electrode 22 in response of a gate voltage Vg; and such written voltage is applied to the liquid crystal layer. Therefore, it is not the case a voltage being applied to the liquid crystal layer is equal to the difference between the image signal Vsig and the counter voltage Vcom as it is.

First, the waveforms of the conventional example will be described.

When black is displayed in frames (1) and (2), the difference between the image signal Vsig and the counter voltage Vcom is $\Delta V_1$ in both of the first frame (frame (1)) and the second frame (frame (2)).

In frames (3) and (4) in which the display color has changed from black to the halftone color, the difference between the image signal Vsig and the counter voltage Vcom is $\Delta V_2$, whereby the halftone voltage is written to a pixel electrode 22.

As described above, the image signal Vsig is given voltage values in such a manner that: the same white voltage is applied to the liquid crystal layer in both of the first and second frames in displaying white; and the same black voltage is applied to the liquid crystal layer in both of the first and second frames in displaying black.

Next, the waveforms of the embodiment will be described.

When black is displayed in frames (1) and (2), the difference between the image signal Vsig and the counter voltage Vcom is $\Delta V_1$ as in the case of the conventional example.

In frames (3) and (4) in which the display color has changed from black to the halftone color, the difference between the image signal Vsig and the counter voltage Vcom is the ordinary halftone voltage difference $\Delta V_2$ plus $V\alpha$ in the first frame (frame(3)). The voltage $\Delta V\alpha$ is added by the above-described correction circuit 54. Where the counter voltage Vcom is inverted to have ±7 V, for example, it is preferable that the voltage $V\alpha$ be greater than a voltage tantamount to one gradation scale (e.g., 1–2 V; preferably 1.5 V).

In the second frame (frame (4)), the ordinary halftone voltage difference $\Delta V_2$ is applied to the liquid crystal layer as in the case of the conventional example. In this manner, the on-response speed is made higher than in the conventional example as described above with reference to FIG. 2.

In frames (5) and (6) in which the display color has changed from the halftone color to white, the difference between the image signal Vsig and the counter voltage Vcom is the ordinary white voltage difference $\Delta V_3$ plus $V\alpha$ in the first frame (frame(5)). In the second frame (frame (6)), the ordinary white voltage difference $\Delta V_3$ is applied to the liquid crystal layer. In this manner, the on-response speed is made higher than in the conventional example as described above with reference to FIG. 2.

In frames (7) and (8) in which the display color has changed from white to black (luminance-decreasing wise change), the image signal Vsig is made approximately equal to the counter voltage Vcom in the first frame (frame (7)). In the second frame (frame (8)), the ordinary black voltage difference $\Delta V_1$ is applied to the liquid crystal layer. In this manner, the off-response speed is made higher than in the conventional example as described above with reference to FIG. 3.

As described above, both of the on-response speed and the off-response speed can be made higher than in the conventional example, whereby the response speed of the entire liquid crystal display device 10 can be made higher than in the conventional case. The liquid crystal display device 10 can display image data satisfactorily even if the image data includes moving picture data like image data produced by a DVD device, a digital TV receiver, or the like.

<Modification 1>

Although the above embodiment is directed to the case where the IPS-mode liquid crystal is used in the liquid crystal layer, the response speed of the liquid crystal can also be increased even in the case where a TN-mode, STN-mode, or VA (vertical alignment)-mode liquid crystal is used.

<Modification 2>

In the above embodiment, the conversion circuit 50 is provided inside the liquid crystal display device 10 to display image data of a DVD device, a digital TV receiver, or the like. Alternatively, a separate conversion circuit 50 may be provided between a conventional liquid crystal display device having only the liquid crystal controller 30 and a DVD device or the like. This makes it possible to increase the response speed of the conventional liquid crystal display device.

As described above, the invention makes it possible to increase both of the on-response speed and the off-response speed and hence to display a moving picture or the like satisfactorily.

CROSS-REFERENCE TO RELATED APPLICATIONS

This application is based upon and claims the benefits of priority from the prior Japanese Patent Applications No. 2001-187281 filed on Jun. 20, 2001; the contents of which are incorporated herein by reference.

What is claimed is:

1. A control device of a liquid crystal display device, comprising:

an array substrate comprised of signal lines, scanning lines being arranged perpendicular to the signal lines, switching elements each being arranged in vicinity of respective crossing point of the signal line and the scanning line, and pixel electrodes each being connected to respective one of the switching elements;

a counter substrate being opposed to the array substrate with a liquid crystal layer interposed therebetween;

a signal line driving circuit for supplying image signals to the respective signal lines; and a scanning line driving circuit for supplying gate signals to the respective scanning lines, the gate signals serving to turn on the switching elements to write the image signals to the pixel electrodes;

said image signals being supplied in a manner for displaying one display pattern during two consecutive frame periods consisting of first and second frames; and when to increase voltage of the image signal as to change luminance, solely voltage at the first frame being set higher than a voltage value of gradation scale corresponding to a given luminance; and then reverted as voltage at the second frame being set to a voltage value of gradation scale corresponding to the given luminance.

2. The control device according to claim 1, wherein a difference between said voltage at the first frame and said voltage value of gradation at the first frame is greater than a voltage corresponding to one gradation scale.

3. A control device of a liquid crystal display device, comprising:

an array substrate comprised of signal lines, scanning lines being arranged perpendicular to the signal lines, switching elements each being arranged in vicinity of respective crossing paint of the signal line and the scanning line, and pixel electrodes each being connected to respective one of the switching elements;

a counter substrate being opposed to the array substrate with a liquid crystal layer interposed therebetween;

a signal line driving circuit for supplying image signals to the respective signal lines; and a scanning line driving circuit for supplying gate signals to the respective scanning lines, the gate signals serving to turn on the switching elements to write the image signals to the pixel electrodes;

said image signals being supplied in a manner for displaying one display pattern during two consecutive frame periods consisting of first and second frames; and when to decrease voltage of the image signal as to change luminance, solely voltage at the first frame being set lower than a voltage value of gradation scale corresponding to a given luminance; and then reverted as voltage at the second frame being set to a voltage value of gradation scale corresponding to the given luminance.

4. The control device according to claim 1 or 3, wherein the liquid crystal layer is formed of an IPS-mode liquid crystal.

5. The control device according to claim 1 or 3, wherein the liquid crystal layer is formed of a TN-mode liquid crystal.

6. The control device according to claim 1 or 3, wherein the liquid crystal layer is formed of an STN-mode liquid crystal.

7. The control device according to claim 1 or 3, wherein the liquid crystal layer is formed of a VA-mode liquid crystal.

* * * * *